US011533569B1

(12) United States Patent
Kervran

(10) Patent No.: US 11,533,569 B1
(45) Date of Patent: Dec. 20, 2022

(54) OPTICAL MICROPHONE WITH A DUAL LIGHT SOURCE

(71) Applicant: AAC ACOUSTIC TECHNOLOGIES (SHENZHEN) CO., LTD., Shenzhen (CN)

(72) Inventor: Yannick Pierre Kervran, HK (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 17/407,197

(22) Filed: Aug. 20, 2021

(51) Int. Cl.
*H04R 23/00* (2006.01)

(52) U.S. Cl.
CPC ..... *H04R 23/008* (2013.01); *H04R 2201/003* (2013.01)

(58) Field of Classification Search
CPC ..... H04R 23/008; H04R 2201/003
See application file for complete search history.

(56) References Cited

U.S. PATENT DOCUMENTS

2021/0274291 A1* 9/2021 Angelskår ..... G01B 9/02051
2022/0182771 A1* 6/2022 Fang ..... G01H 9/00

* cited by examiner

*Primary Examiner* — Mark Fischer
(74) *Attorney, Agent, or Firm* — W&G Law Group

(57) ABSTRACT

An optical microphone with a dual light source is provided. The optical microphone includes: a housing including an inner cavity and a sound inlet communicating the inner cavity with the outside; a MEMS module disposed in the inner cavity and including a flexible membrane and two gratings; two photoelectric modules, one being disposed in a front cavity and the other in a rear cavity, and each of the photoelectric modules including a light source and a light detector; and an ASIC module disposed in the rear cavity and electrically connected to the photoelectric modules. The optical microphone provides differential measurement, such that the output signal change on one of the two sides of the flexible membrane is positive and the output signal change on another side of the flexible membrane is negative. Therefore, a differential measurement structure is formed to improve the performance of the microphone.

10 Claims, 2 Drawing Sheets

OPTICAL MICROPHONE WITH A DUAL LIGHT SOURCE

TECHNICAL FIELD

The present disclosure relates to the technical field of microphones, and in particular, to an optical microphone with a dual light source.

BACKGROUND

The common microphone includes a capacitor and a vibrating diaphragm that vibrates through sound waves, and generates voltage changes by changing the distance between the vibrating diaphragm and the non-movable reference plate of the capacitor, thereby achieving acoustoelectric conversion.

An optical microphone is a microphone that can include three modules, i.e., a photoelectric module, an application specific integrated circuit (ASIC) module and a micro-electro-mechanical-system (MEMS) module. The photoelectric module may send light toward the MEMS module and receive the light reflected by the MEMS module. When a diaphragm of the MEMS module vibrates through sound waves, the diaphragm slightly vibrates and changes the intensity and phase of the light reflected back to the photoelectric module. The photoelectric module then converts intensity and phase signals of the reflected light into electrical signals and transmits the electrical signals to the ASIC module, such that acoustic signals are converted into optical signals and the optical signals are then converted into electrical signals.

As consumers have increasingly requirements for experience, an optical microphone with good acoustic-optical conversion performance is required.

SUMMARY

The present disclosure provides an optical microphone with a dual light source, which can improve the performance of the optical microphone.

In some embodiments, an optical microphone with a dual light source is provided. The optical microphone includes a housing including an inner cavity and a sound inlet communicating the inner cavity with outside, a MEMS module disposed in the inner cavity and including a flexible membrane and two gratings, two photoelectric modules, and an ASIC module disposed in the rear cavity and electrically connected to the two photoelectric modules. The flexible membrane divides the inner cavity into a front cavity and a rear cavity along an incident direction of a sound wave. One of the two photoelectric modules is disposed in the front cavity and another of the two photoelectric modules is disposed in the rear cavity, and each of the two photoelectric modules includes a light source and a light detector. The front cavity is in communication with the outside through the sound inlet. One of the two gratings is disposed at one of two opposite sides of the flexible membrane within the front cavity and spaced apart from the flexible membrane, and another of the two gratings is disposed at another of the two opposite sides of the flexible membrane within the rear cavity and spaced apart from the flexible membrane. Each of the two opposite sides of the flexible membrane is provided with a reflective layer, and one side of each of the two gratings facing toward the light source of one of the two photoelectric modules adjacent to the grating is provided with a reflective layer. A part of light emitted by the light source of one photoelectric module of the two photoelectric modules is diffracted by one grating of the two gratings adjacent to the photoelectric module, and then is irradiated on the flexible membrane and reflected back to the light detector of the one photoelectric module through the flexible membrane. Another part of the light is directly reflected back to the light detector of the one photoelectric module through the reflective layer of the one grating.

As an improvement, the dual light source further includes a lens that is disposed between each of the two gratings and one of the two photoelectric modules adjacent to the grating and spaced apart from the grating. When the light emitted by the light source is vertically irradiated on the lens, the light is refracted by the lens and then obliquely irradiated to the grating. When the light reflected by the grating or the flexible membrane is obliquely irradiated to the lens, the reflected light is refracted by the lens and then vertically irradiated on the light detector.

As an improvement, the flexible membrane is further provided with a hole communicating the front cavity with the rear cavity.

As an improvement, each of the two gratings comprises a plurality of grooves that is parallel to and spaced apart from each other.

As an improvement, each of the two gratings is made of a lens, and the lens is provided with at least one diffraction layer.

As an improvement, the light source and the light detector of each of the two photoelectric modules are disposed on different dies.

As an improvement, each of the two photoelectric modules includes a plurality of light detectors.

As an improvement, the light source and the light detector of each of the two photoelectric modules are disposed on a same die.

As an improvement, the ASIC module is electrically connected to the flexible membrane and the two gratings.

As an improvement, the MEMS module further includes a support arm that is configured to support the flexible membrane and is fixed to the housing. The one grating of the two gratings is spaced apart from the flexible membrane through a first support member, and the other grating of the two gratings is spaced apart from the flexible membrane through a second support member.

In the optical microphone of the present disclosure, each of the two opposite sides of the flexible membrane is provided with the grating and the photoelectric module, and a gap is formed between the flexible membrane and the grating, thereby obtaining differential measurement. In this way, the output signal on one of the two sides of the flexible membrane is positive and the output signal on another side of the flexible membrane is negative. Therefore, a differential measurement structure is formed to improve the performance of the microphone.

DESCRIPTION OF REFERENCE SIGNS

1: housing, 11: sound inlet, 12: first housing wall, 13: second housing wall, 14: side housing wall, 15: inner cavity, 16: front cavity, 17: rear cavity;

2: MEMS module, 21: flexible membrane, 22: grating, 23: hole, 24: support arm, 25: first support member, 26: second support member;

3: photoelectric module, 31: light source, 32: light detector;

4: ASIC module;

A: incident light beam;

B: reflected light beam;

X: incident direction of a sound wave.

DESCRIPTION OF EMBODIMENTS

Embodiments of the present disclosure will be described in detail in the following description, examples of which are shown in the accompanying drawings. The same or similar elements with the same or similar functions are indicated by the same or similar reference signs throughout the description. The embodiments described below with reference to the accompanying drawings are illustrative, and intend to construe the present disclosure, instead of limiting the present disclosure thereto.

Figure 1:
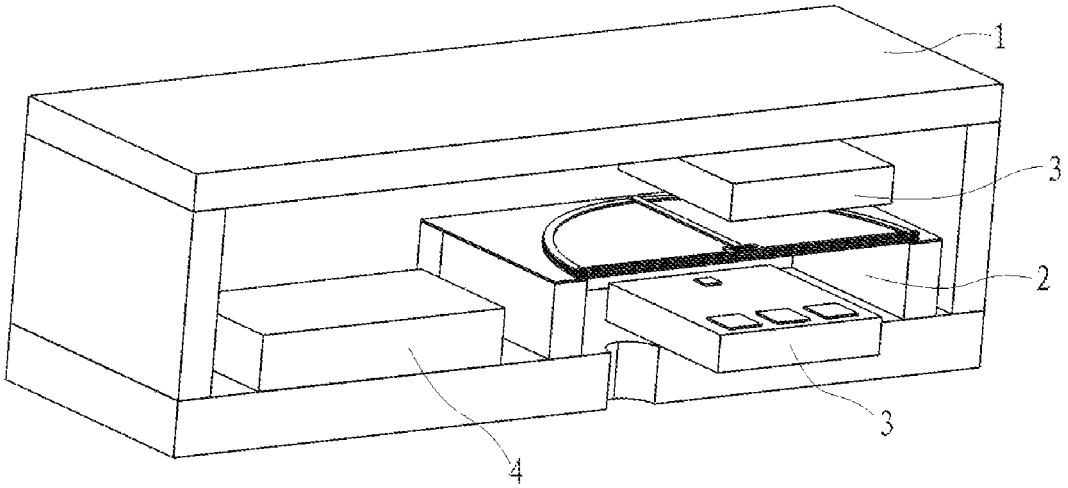
FIG. 1 is a perspective diagram of an optical microphone according to an embodiment of the present disclosure.
Figure 2:
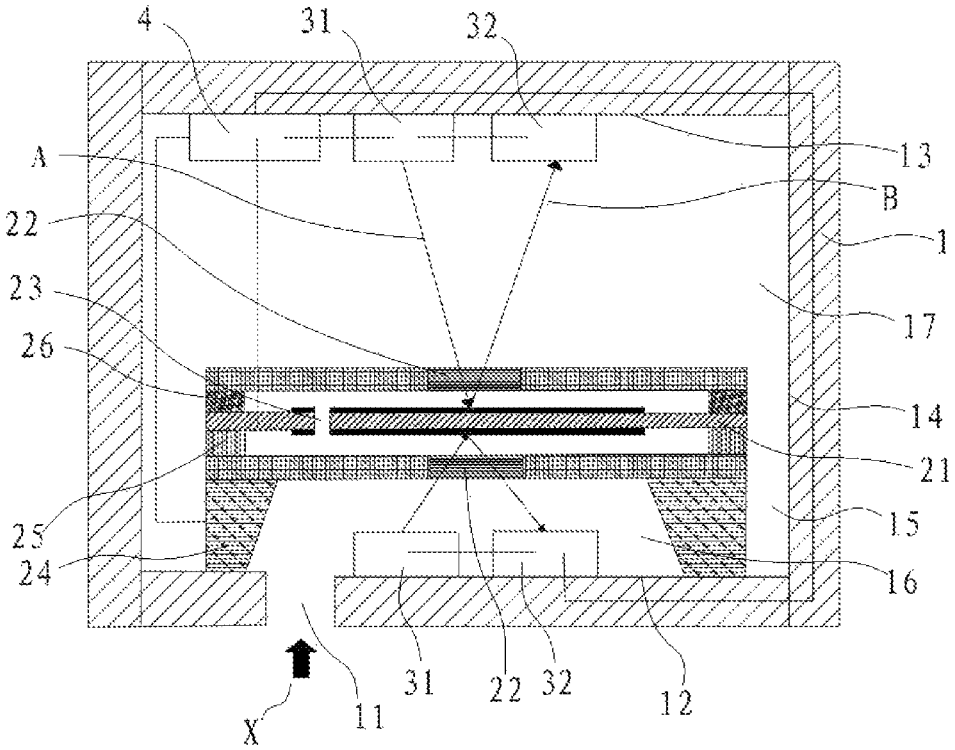
FIG. 2 is a schematic diagram of a cross section of the optical microphone shown in FIG. 1.

In some embodiments, an optical microphone with a dual light source includes a housing 1, a MEMS module 2, two photoelectric modules 3 and an ASIC module, as shown in FIG. 1 and FIG. 2.

The housing 1 has an inner cavity 15 and a sound inlet 11 communicating the inner cavity 15 with the outside. In at least one embodiment, the housing 1 includes a first housing wall 12, a second housing wall 13, and a side housing wall 14 connecting the first housing wall 12 and the second housing wall 13, which enclose the inner cavity 15. The first housing wall 12 is opposite to the second housing wall 13. The sound inlet 11 is provided at the first housing wall 12. In some embodiments, the side housing wall 14 may be integrally formed as a part of the first housing wall 12 or the second housing wall 13, or may be an individual wall.

The MEMS module 2 is disposed at the first housing wall 12 inside the inner cavity 15, and includes a flexible membrane 21 and two gratings 22. The flexible membrane 21 divides the inner cavity 15 into a front cavity 16 and a rear cavity 17 along an incident direction X of a sound wave. The front cavity 16 is in communication with the outside through the sound inlet 11. The front cavity 16 is a volume between the flexible membrane 21 and the sound inlet 11, and the rear cavity 17 is a volume between the flexible membrane 21 and an internal volume of the housing 1. In addition, the flexible membrane 21 of the MEMS module 2 is adjacent to the sound inlet 11, such that the front cavity 16 has a small size and the rear cavity 17 has a large size, thereby further improving the performance of the optical microphone.

The two gratings 22 are arranged at two opposite sides of the flexible membrane 21. One of the gratings 22 is disposed at one of the two opposite sides of the flexible membrane 21 within the front cavity 16 and spaced apart from the flexible membrane 21, and another of the gratings 22 is disposed at another of the two opposite sides of the flexible membrane 21 within the rear cavity 17 and spaced apart from the flexible membrane 21.

In at least one embodiment, the MEMS module 2 further includes a support arm 24 that is configured to support the flexible membrane 21 and is fixed to the first housing wall 12.

In some embodiments, the one grating 22 is spaced apart from the flexible membrane 21 through a first support member 25, and is disposed at the one side of the flexible membrane 21 within the front cavity 16. The first support member 25 is configured to support and fix the one grating 22, such that a first gap is formed between the one grating 22 and the flexible membrane 21.

In some embodiments, the another of the gratings 22 is spaced apart from the flexible membrane 21 through a second support member 26, and is disposed at the another side of the flexible membrane 21 within the rear cavity 17. The second support member 26 is configured to support and fix the another grating 22, such that a second gap is formed between the another grating 22 and the flexible membrane 21. In this case, the first gap may be equal to the second gap.

One of the two photoelectric modules 3 is disposed on the first housing wall 12 within the front cavity 16, and another of the two photoelectric modules 3 is disposed on the second housing wall 13 within the rear cavity 17. Each of the two photoelectric modules 3 includes a light source 31 and a light detector 32.

The ASIC module 4 is disposed in the rear cavity 17 and electrically connected to the photoelectric modules 3.

Each of the two opposite sides of the flexible membrane 21 is provided with a reflective layer, and one side of each of the gratings 22 facing toward one of the light sources 31 adjacent to the grating is provided with a reflective layer. The reflective layer may be made of one material or be a stack of different materials. The reflection efficiency of the reflective layer depends on a wavelength of incident light, and the material of each of the reflective layer is selected to maximize the reflectivity of the incident light.

A part of light emitted by the light source 31 is diffracted by the grating 22, then irradiated on the flexible membrane 21, and reflected back to the light detector 32 through the flexible membrane 21. Another part of the light emitted by the light source 31 is directly reflected back to the light detector 32 through the reflective layer of the grating 22.

When the optical microphone is in use, the sound wave enters the housing 1 through the sound inlet 11 and vibrates the flexible membrane 21 to change a distance between the flexible membrane 21 and each of the two gratings 22. When the flexible membrane 21 vibrates, the flexible membrane 21 moves upwards or downwards like a standard oscillating structure, which depends on the type of the microphone. The upward movement and downward movement of the flexible membrane 21 are switched with a predetermined frequency and have a predetermined displacement. The frequency depends on a frequency of the sound wave, and the displacement depends on a pressure of the sound wave.

Each of the light sources 31 emits a light beam, which is referred to as an incident light beam A and is directed to the center of the grating 22 at the corresponding side and the center of the flexible membrane 21 at the corresponding side. A light beam reflected back to the light detector 32 is referred to as a reflected light beam B. Since the grating 22 is placed between the light source 31 and the flexible membrane 21 at the corresponding side, the incident light beam A reaches the grating 22 before reaching the flexible membrane 21.

A surface of the grating 22 facing toward the light source 31 is highly reflective such that the incident light beam A is highly reflected toward the light detector 32. In some embodiments, each of the gratings 22 includes a plurality of grooves that is parallel to and spaced apart from each other. A part of the light passing through the grooves of the grating 22 is diffracted and reaches a reflective surface of the flexible membrane 21. The light reflected by the flexible membrane 21 is then directed to the light detector 32. In this way, there is an intensity difference and a phase difference between the two parts of the reflected light beam B when they reach the light detector 32. The intensity difference and phase difference are related to a distance between the flexible membrane 21 and the corresponding grating 22. Therefore, the MEMS module 2, the optoelectronic modules 3, and the ASIC module 4 may achieve the conversion from acoustic signals to optical signals and the conversion from the optical signals to electrical signals.

Figure 3:
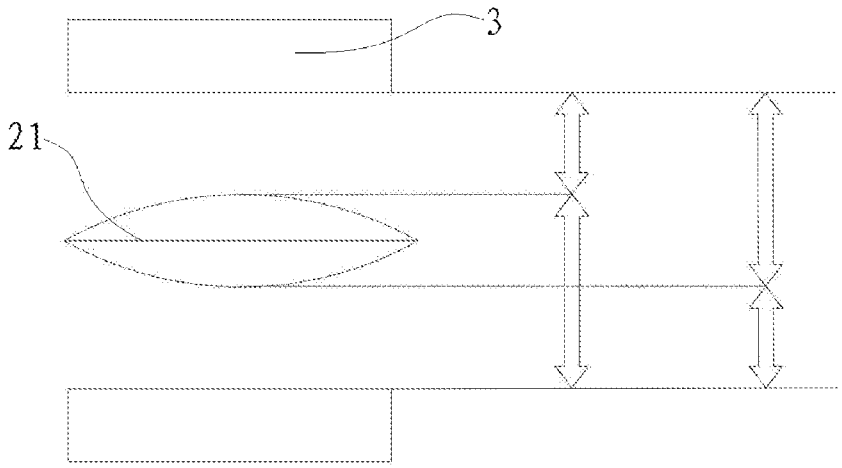
FIG. 3 is a schematic structural diagram of a flexible membrane in a vibration state according to an embodiment of the present disclosure.

As shown in FIG. 2 and FIG. 3, each of the two sides of the flexible membrane 21 is provided with the grating 22 and the optoelectronic module 3, so that the optical microphone with a dual light source of the present disclosure can provide differential measurement. Signals measured on the two sides of the flexible membrane 21 are opposite to each other, and the combination of the two photoelectric modules 3 can improve the performance of the microphone. If the output signal on one side is positive and the output signal on the other side is negative, a differential measurement structure is formed to improve the performance of the microphone.

In at least one embodiment, the optical microphone further includes a lens (not shown) that is disposed between each of the two gratings 22 and one of the photoelectric modules 3 adjacent to the grating and spaced apart from the grating 22. When the light emitted by the light source 31 is vertically irradiated on the lens, the emitted light is refracted by the lens and then tilted to the grating 22. When the light reflected by the grating 22 or the flexible membrane 21 is obliquely irradiated to the lens, the reflected light is refracted by the lens and then vertically irradiated to the light detector 32.

In some embodiments, the one side of the grating 22 facing toward the photoelectric module 3 is provided with a lens. A path of the light emitted by the light source 31 may be changed by a refraction effect of the lens on the emitted light. In this way, a die of each of the light source 31 may be placed on the corresponding housing wall of the housing 1, so that the light emitted from the light source 31 is directly irradiated to the grating 22 at an incident angle, which is less than 90°. Further, a die of each the light detectors 32 may also be placed on the corresponding housing wall of the housing 1. Therefore, this structure makes it easier to provide the light sources 31 and the light detectors 32.

In some embodiments, the flexible membrane 21 is further provided with a hole 23 communicating the front cavity 16 and the rear cavity 17. As shown in FIG. 2, the hole 23 can communicate the front cavity 16 and the rear cavity 17 to balance sound pressures inside the front cavity 16 and the rear cavity 17 and allow sound to pass therethrough, thereby facilitating the vibration of the flexible membrane 21 under the action of the sound wave.

In some embodiments, the grating 22 may be provided with a reflective plane. For example, the grating 22 has a substrate made of silicon, and a metal film is plated at the one side of the silicon facing toward the photoelectric module 3 to be formed as a reflective layer. The metal film may be made of a metal, such as gold, aluminum, silver or copper.

In at least one embodiment, the grating 22 is made of a lens, on which at least one diffraction layer is provided.

In some embodiments, the lens may include a substrate made of glass. A diffraction surface is formed by forming an uneven surface with regular undulations (such as, steps) on the substrate, and the light is diffracted through the diffraction surface structure.

In some embodiments, as shown in FIG. 2, the ASIC module 4 is electrically connected to the flexible membrane 21 and the gratings 22, respectively, to apply an electric voltage between the flexible membrane 21 and each of the gratings 22 to generate an electrostatic force therebetween. Accordingly, an "electrostatic spring" can be generated between the flexible membrane 21 and each of the gratings 22. When the flexible membrane 21 vibrates dues to the sound wave, the "electrostatic spring" can function to "increase" or "reduce" a vibrating deformation amount of the flexible membrane 21.

In some embodiments, the housing 1 may be made of a PCB board with circuits. The ASIC module 4 may be electrically connected to the flexible membrane 21 and the gratings 22 through the circuits. Further, the ASIC module 4 may be disposed on the first housing wall 12, the second housing wall 13, or the side housing wall 14. For example, as shown in FIG. 1, the ASIC module 4 is disposed on the first housing wall 12; as shown in FIG. 2, the ASIC module 4 is disposed on the second housing wall 13.

In some embodiments, the two photoelectric modules can be composed of two different dies, i.e., one configured to emit the light, one or both configured to receive the reflected light. In this case, the light source 31 and the light detector 32 are disposed on different dies.

Specifically, the light source 31 may be a laser diode, and the light detector 32 may be a photodiode. The laser diode and the photodiode are disposed on different dies.

In some embodiments, each of the photoelectric modules 3 may include a plurality of light detectors 32.

In some embodiments, the light source 31 and the light detector 32 may be disposed on the same die. In this way, the entire structure of the photoelectric module 3 can be simplified while facilitating installation of the photoelectric modules 3.

The above descriptions are merely some embodiments of the present disclosure, and the scope of the present disclosure is not limited by the drawings. Any modification, equivalent replacement, improvement, etc. made within the spirit and principle of the present disclosure shall fall within the scope of the present disclosure.

What is claimed is:

1. An optical microphone with a dual light source, comprising:

a housing comprising an inner cavity and a sound inlet communicating the inner cavity with outside;

a micro-electro-mechanical-system (MEMS) module, the MEMS module being disposed in the inner cavity and comprising a flexible membrane and two gratings, the flexible membrane dividing the inner cavity into a front cavity and a rear cavity along an incident direction of sound;

two photoelectric modules, one of the two photoelectric modules being disposed in the front cavity and another of the two photoelectric modules being disposed in the rear cavity, and each of the two photoelectric modules comprising a light source and a light detector; and an application specific integrated circuit (ASIC) module disposed in the rear cavity and electrically connected to the two photoelectric modules, wherein the front cavity is in communication with the outside through the sound inlet, one of the two gratings is disposed at one of two opposite sides of the flexible membrane within the front cavity and spaced apart from the flexible membrane, and another of the two gratings is disposed at another of the two opposite sides of the flexible membrane within the rear cavity and spaced apart from the flexible membrane, wherein each of the two opposite sides of the flexible membrane is provided with a reflective layer, and one side of each of the two gratings facing toward the light source of one of the two photoelectric modules adjacent to the grating is provided with a reflective layer, and wherein a part of light emitted by the light source of one photoelectric module of the two photoelectric modules is diffracted by one grating of the two gratings adjacent to the photoelectric module, and then is irradiated on the flexible membrane and reflected back to the light detector of the one photoelectric module through the flexible membrane, and another part of the light is directly reflected back to the light detector of the one photoelectric module through the reflective layer of the one grating.

2. The optical microphone with the dual light source as described in claim 1, further comprising:

a lens disposed between each of the two gratings and one of the two photoelectric modules adjacent to the grating and spaced apart from the grating, wherein when the light emitted by the light source is vertically irradiated on the lens, the light is refracted by the lens and then obliquely irradiated to the grating; and wherein when the light reflected by the grating or the flexible membrane is obliquely irradiated to the lens, the reflected light is refracted by the lens and then vertically irradiated on the light detector.

3. The optical microphone with the dual light source as described in claim 1, wherein the flexible membrane is further provided with a hole communicating the front cavity with the rear cavity.

4. The optical microphone with the dual light source as described in claim 1, wherein each of the two gratings comprises a plurality of grooves that is parallel to and spaced apart from each other.

5. The optical microphone with the dual light source as described in claim 1, wherein each of the two gratings is made of a lens, and the lens is provided with at least one diffraction layer.

6. The optical microphone with the dual light source as described in claim 1, wherein the light source and the light detector of each of the two photoelectric modules are disposed on different dies.

7. The optical microphone with the dual light source as described in claim 6, wherein each of the two photoelectric modules comprises a plurality of light detectors.

8. The optical microphone with the dual light source as described in claim 1, wherein the light source and the light detector of each of the two photoelectric modules are disposed on a same die.

9. The optical microphone with the dual light source as described in claim 1, wherein the ASIC module is electrically connected to the flexible membrane and the two gratings.

10. The optical microphone with the dual light source as described in claim 1, wherein the MEMS module further comprises a support arm, and the support arm is configured to support the flexible membrane and is fixed to the housing;

the one grating of the two gratings is spaced apart from the flexible membrane through a first support member; and the another grating of the two gratings is spaced apart from the flexible membrane through a second support member.

* * * * *